US007965219B1

(12) United States Patent
Humfeld

(10) Patent No.: US 7,965,219 B1
(45) Date of Patent: Jun. 21, 2011

(54) PATTERNED OPTICAL MATERIAL AND METAMATERIAL FOR PROTECTION FROM AND DEFEAT OF DIRECTED ENERGY

(75) Inventor: Keith Daniel Humfeld, Garden Grove, CA (US)

(73) Assignee: The Boeing Company, Chicago, IL (US)

( * ) Notice: Subject to any disclaimer, the term of this patent is extended or adjusted under 35 U.S.C. 154(b) by 91 days.

(21) Appl. No.: 12/566,156

(22) Filed: Sep. 24, 2009

(51) Int. Cl.
*H01Q 15/00* (2006.01)

(52) U.S. Cl. ..... 342/5; 342/1

(58) Field of Classification Search ..... 342/1–12
See application file for complete search history.

(56) References Cited

U.S. PATENT DOCUMENTS

2004/0169616 A1* 9/2004 Schultz et al. ..... 343/872

OTHER PUBLICATIONS

Yao, et al., Optical Negative Refraction in Bulk Metamaterials of Nanowires, sciencemag.org, Aug. 15, 2008, 1 page, vol. 321.

* cited by examiner

*Primary Examiner* — Thomas H Tarcza
*Assistant Examiner* — Timothy A Brainard
(74) *Attorney, Agent, or Firm* — Armstrong Teasdale LLP

(57) ABSTRACT

A structure is described that includes a plurality of columnar pieces of metamaterial, and a plurality of columnar pieces of non-metamaterial. The columnar pieces are arranged in an alternating pattern adjacent one another, and the metamaterial and the non-metamaterial are chosen such that indices of refraction for each are equal in magnitude, but opposite in sign, at a chosen wavelength, such that incident radiation is returned directly towards its source.

21 Claims, 5 Drawing Sheets

PATTERNED OPTICAL MATERIAL AND METAMATERIAL FOR PROTECTION FROM AND DEFEAT OF DIRECTED ENERGY

BACKGROUND

The field of the disclosure relates generally to metamaterials, and more specifically, to alternating geometrical patterns of optical material and optical metamaterial for protection from and defeat of directed energy.

With the continuing development of high power microwave transmission capabilities, air and ground vehicles, both commercial and military, are susceptible to high power microwave attacks. Fortunately, some vehicles that utilize metallic bodies can absorb incoming microwave radiation. However, there is a general trend away from metallic structures and towards composite structures in such vehicles as composite structures offer significant weight savings over metallic structures.

BRIEF DESCRIPTION

In one aspect, a structure is provided that includes a plurality of columnar pieces of metamaterial and a plurality of columnar pieces of non-metamaterial. The non-metamaterial may be a normal optical material. The columnar pieces are arranged in an alternating pattern adjacent one another, and the metamaterial and the non-metamaterial are chosen such that indices of refraction for each are equal in magnitude, but opposite in sign, at a chosen wavelength, such that incident radiation is returned directly towards its source.

The features, functions, and advantages that have been discussed can be achieved independently in various embodiments of the present invention or may be combined in yet other embodiments further details of which can be seen with reference to the following description and drawings.

DETAILED DESCRIPTION

The described embodiments relate to the patterning of metamaterials and non-metamaterials, and the application of such patterning to provide electromagnetic protection. Non-metamaterials may sometimes be referred to herein as "normal" materials or optical materials. All optical metamaterials are patterned structures with elements shorter than the wavelength of incident radiation. The present disclosure introduces a pattern on a second length scale, where the two elements of this pattern are an optical metamaterial and a normal optical material. More specifically, the described embodiments further describe how the application of such patterning provides shielding from high power microwave radiation.

The disclosed structure can be utilized to protect, for example, vehicles from high power microwave energy by reflecting the incident radiation. In addition, the disclosed structure can defeat directed energy by reflecting the incident radiation directly back towards the source, regardless of the relative orientation of the source and the disclosed structure.

Figure 1:
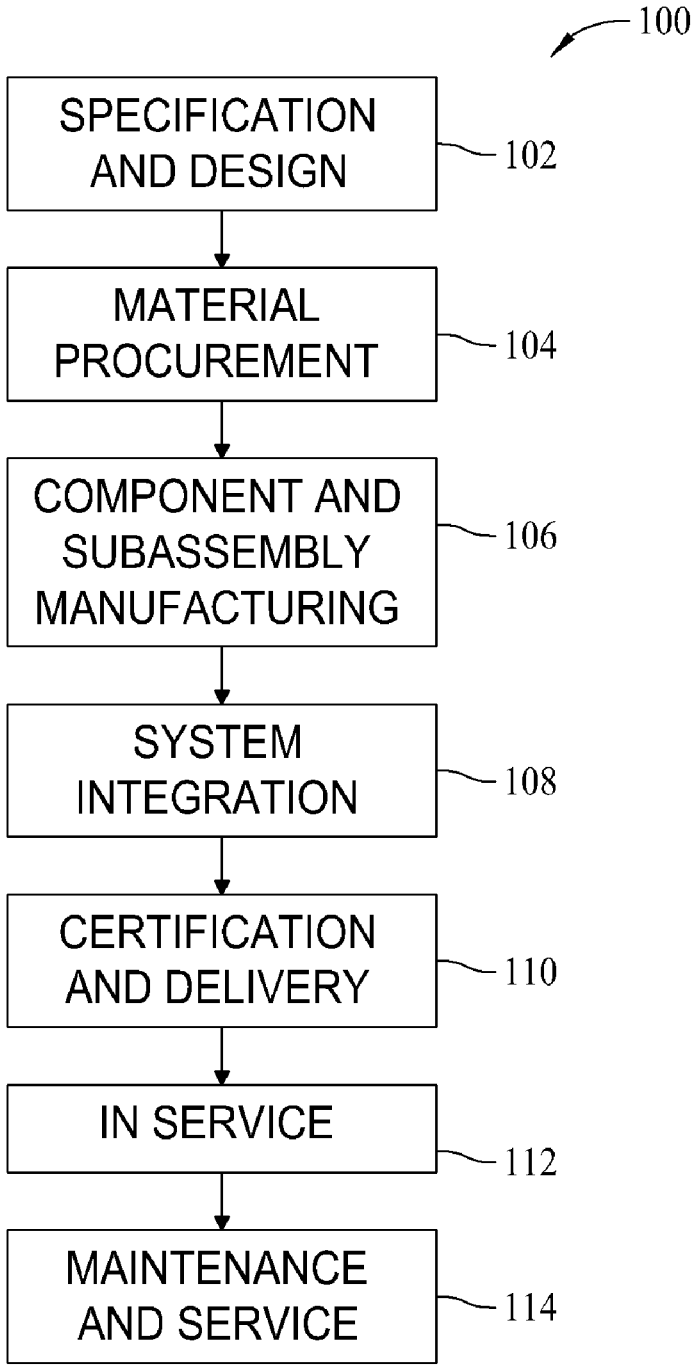
FIG. 1 is a flow diagram of an aircraft production and service methodology.
Figure 2:
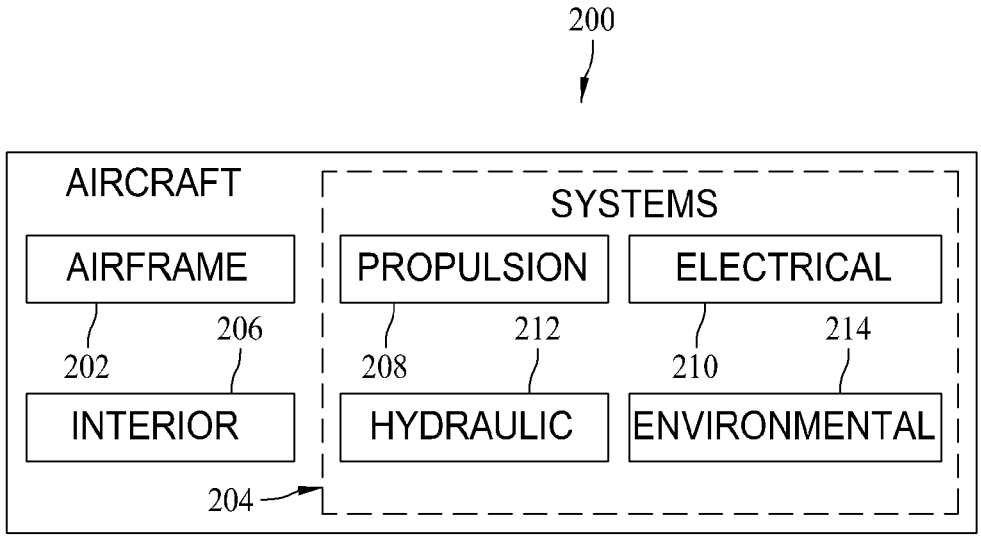
FIG. 2 is a block diagram of an aircraft.

Referring more particularly to the drawings, embodiments of the disclosure may be described in the context of aircraft manufacturing and service method 100 as shown in FIG. 1 and an aircraft 200 as shown in FIG. 2. During pre-production, aircraft manufacturing and service method 100 may include specification and design 102 of aircraft 200 and material procurement 104.

During production, component and subassembly manufacturing 106 and system integration 108 of aircraft 200 takes place. Thereafter, aircraft 200 may go through certification and delivery 110 in order to be placed in service 112. While in service by a customer, aircraft 200 is scheduled for routine maintenance and service 114 (which may also include modification, reconfiguration, refurbishment, and so on).

Each of the processes of aircraft manufacturing and service method 100 may be performed or carried out by a system integrator, a third party, and/or an operator (e.g., a customer). For the purposes of this description, a system integrator may include, without limitation, any number of aircraft manufacturers and major-system subcontractors; a third party may include, for example, without limitation, any number of venders, subcontractors, and suppliers; and an operator may be an airline, leasing company, military entity, service organization, and so on.

As shown in FIG. 2, aircraft 200 produced by aircraft manufacturing and service method 100 may include airframe 202 with a plurality of systems 204 and interior 206. Examples of systems 204 include one or more of propulsion system 208, electrical system 210, hydraulic system 212, and environmental system 214. Any number of other systems may be included in this example. Although an aerospace example is shown, the principles of the disclosure may be applied to other industries, such as the automotive industry.

Apparatus and methods embodied herein may be employed during any one or more of the stages of aircraft manufacturing and service method 100. For example, without limitation, components or subassemblies corresponding to component and subassembly manufacturing 106 may be fabricated or manufactured in a manner similar to components or subassemblies produced while aircraft 200 is in service.

Also, one or more apparatus embodiments, method embodiments, or a combination thereof may be utilized during component and subassembly manufacturing 106 and system integration 108, for example, without limitation, by substantially expediting assembly of or reducing the cost of aircraft 200. Similarly, one or more of apparatus embodiments, method embodiments, or a combination thereof may be utilized while aircraft 200 is in service, for example, without limitation, to maintenance and service 114 may be used during system integration 108 and/or maintenance and service 114 to determine whether parts may be connected and/or mated to each other.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

Figure 3:
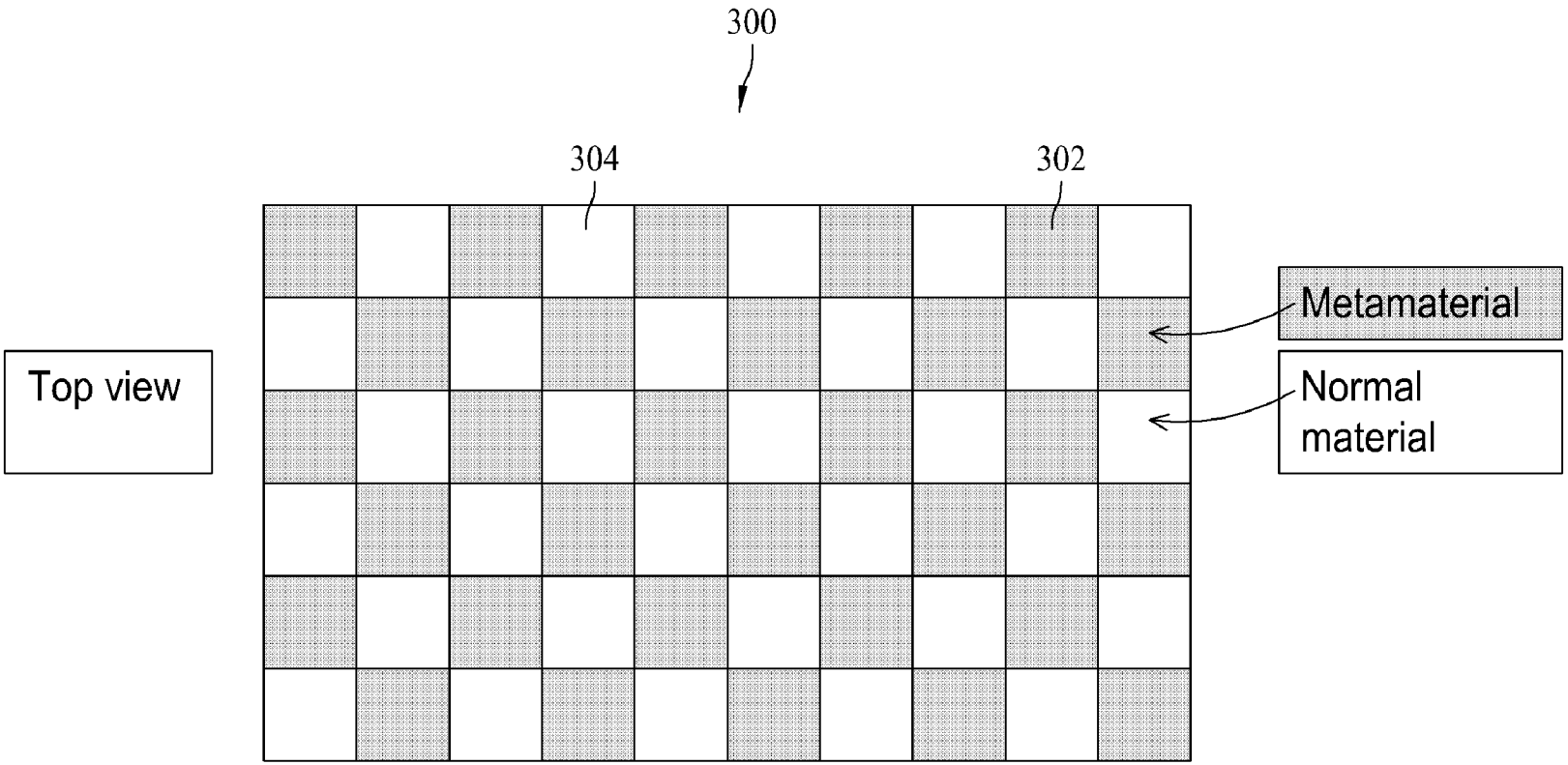
FIG. 3 is a top view depiction of an alternating grid of metamaterial and a non-metamaterial.
Figure 4:
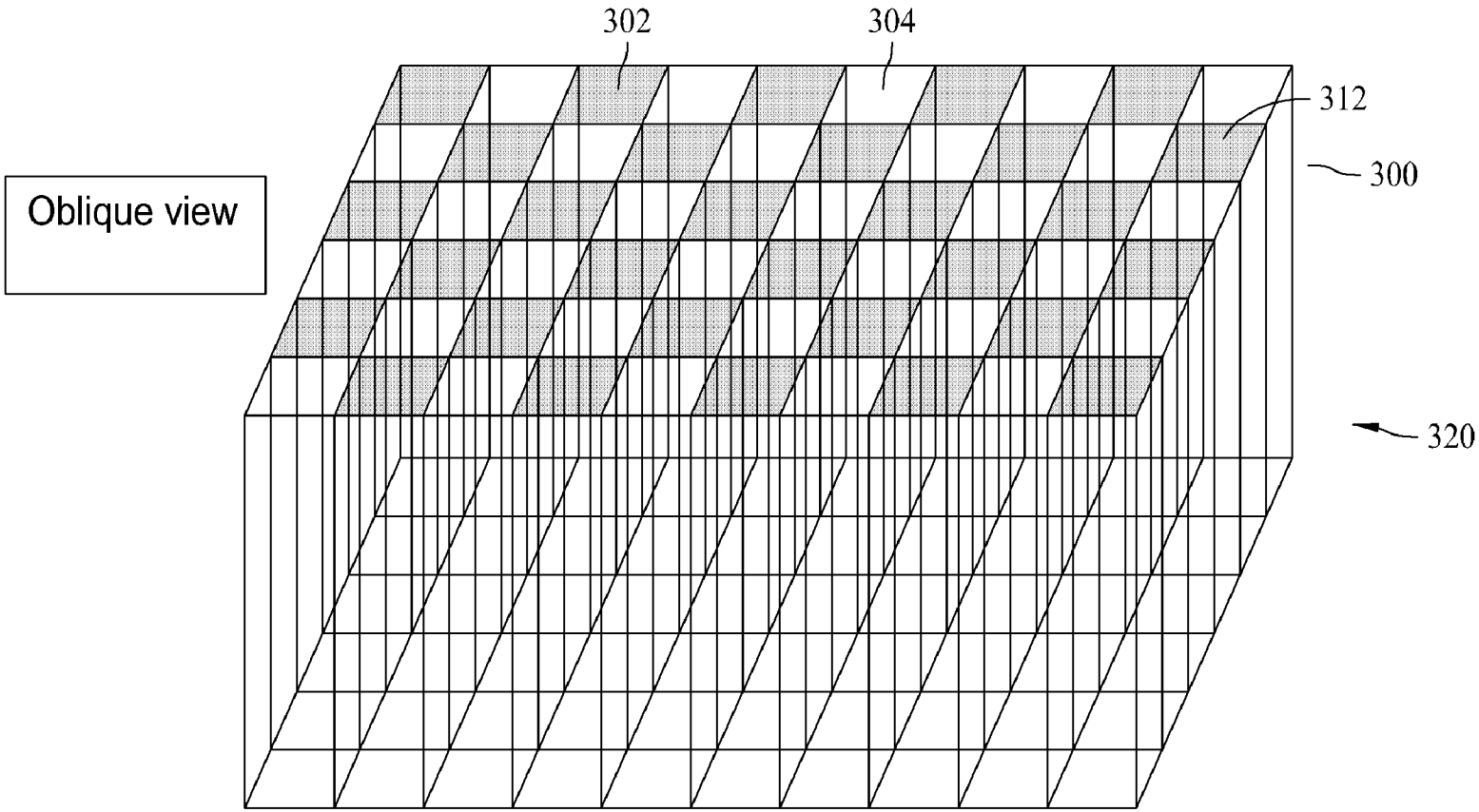
FIG. 4 is an oblique view of the grid of FIG. 3, illustrating a depth associated with the metamaterial and the non-metamaterial.

FIG. 3 is a top view depiction of an alternating grid 300 of a metamaterial 302 and non-metamaterial 304. Non-metamaterial 304 is sometimes referred to herein as a "normal" material. In one embodiment, the alternating grid 300 is a patterned area of metamaterial 302 and non-metamaterial 304 for protection from directed energy. Referring also to FIG. 4, the structure is three-dimensional and includes a plurality of columnar pieces of metamaterial 302 and a plurality of columnar pieces of non-metamaterial 304. In one embodiment, the metamaterial 302 is related to the non-metamaterial 304 such that the indices of refraction are equal in magnitude but opposite in sign at a chosen wavelength.

One aspect of the alternating grid pattern is that it is not a monolithic solution, as are many existing energy absorbing solutions. Existing energy absorbing solutions are those where a single component provides the entire solution and includes structures that absorb incident radiation. Other solutions include a single component that reflects the incoming radiation in a direction that is normal to the incoming radiation. The alternating grid 300 operates such that incident radiation is reflected directly towards its source. Since the alternating grid 300 reflects incident radiation back to its source, a platform incorporating the alternating grid 300 of metamaterials and non-metamaterials would be shielded from directed energy and ultimately direct and return that energy towards its source.

Now referring again to FIG. 4, it is seen that the base elements of alternating grid 300 are columnar pieces 312 of metamaterials 302 and columnar pieces 314 of non-metamaterials 304. The end product illustrated in FIG. 4 is a patterned, three-dimensional structure 320 of metamaterial 302 and an optical material (referred to herein as non-metamaterials 304), with a high aspect ratio in the dimension that is coaxial with the length of the columnar pieces 312 and 314*s*) and an alternating grid 300, or chessboard, pattern in the other two dimensions.

Figure 5:
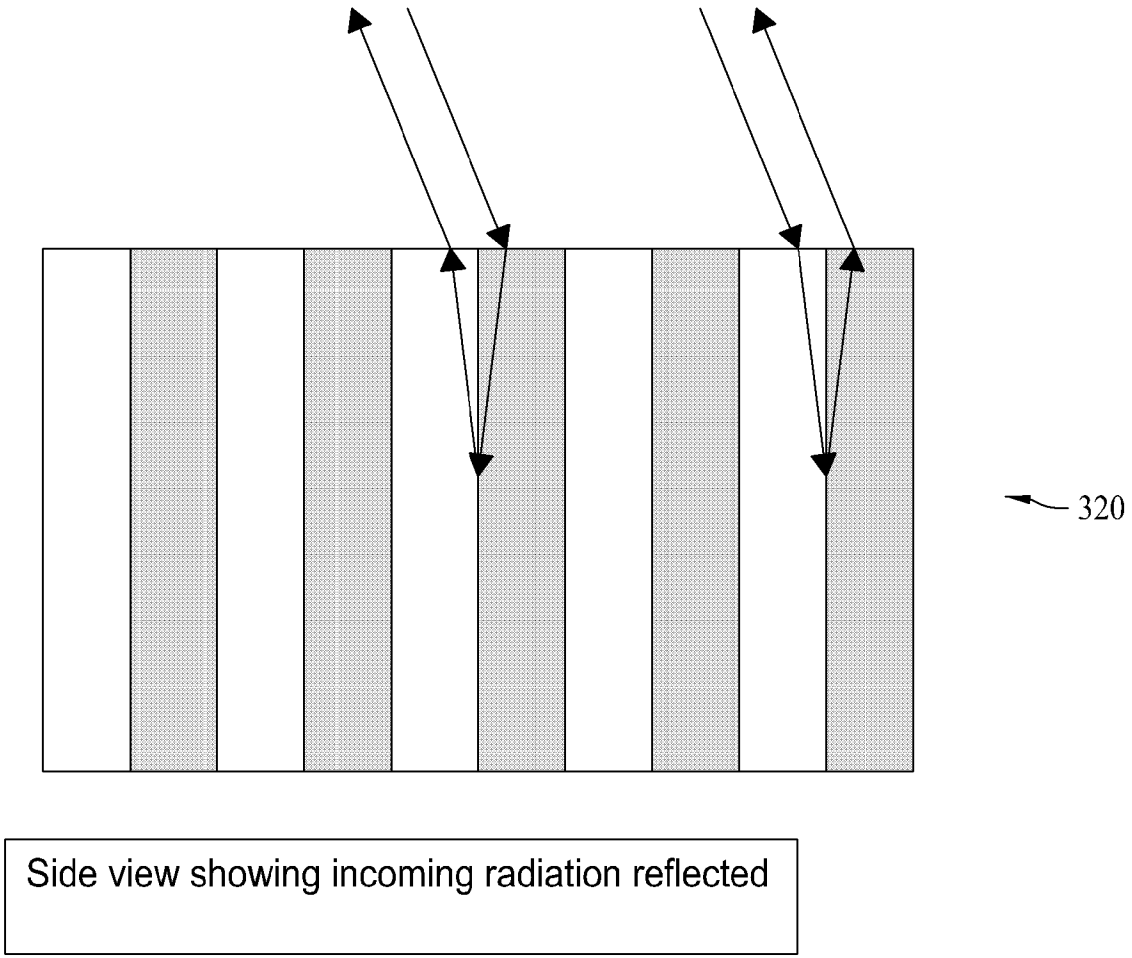
FIG. 5 is a side view of the grid of FIGS. 3 and 4 illustrating incoming radiation through the metamaterial and reflection of the incoming radiation back through the non-metamaterial, and illustrating incoming radiation through the non-metamaterial and reflection of the incoming radiation back through the metamaterial.

FIG. 5 illustrates that the materials from which columnar pieces 312 and 314 are fabricated are chosen such that each columnar piece 314 has an index of refraction that is equal in magnitude, but opposite in sign, to an index of refraction of the adjacent columnar piece 312, at least for a chosen wavelength.

Those skilled in the art will realize that the structure 320 of columnar pieces 312 of metamaterials 302 and columnar pieces 314 of non-metamaterials 304 may be fabricated on a substrate that is processed in only one half of the total area, resulting in the alternating grid configuration illustrated in FIGS. 3-5. A fabrication process that converts normal optical material 304 to metamaterial 302 can produce the structure 320 of columnar pieces, when the process is applied to selected regions that comprise half of the surface 300.

Examples of metamaterials 302 include silica nanospheres within a water matrix, silver nanowires within an aluminum oxide matrix, and other materials that have nanocomponents with separation distances therebetween that are smaller than the wavelength of incident radiation, such as separations less than one micron (one millionth of a meter) for microwave radiation. Examples of non-metamaterials include glass, water, and aluminum oxide. Silver nanowires within an aluminum oxide matrix is one metamaterial that can be designed to have the same index of refraction (but opposite in sign) as the normal material aluminum oxide.

While FIGS. 3-5 depict columnar pieces 312 and 314 as having a square cross-section, it is believed that other cross-sectional shapes may be utilized. However, the square pattern has advantages in reflection due to the interfaces between the individual columnar pieces 312 and 314 all being of the same dimension.

In addition, the length of the columns of the materials is dependent on the range of angles for the anticipated incident radiation. More specifically, the columnar pieces 312 and 314 are of a depth such that the incident beam is reflected back towards the source before the incident beam passes through the entire length of metamaterial column 312 and onto a substructure on which the structure 320 has been placed. As such, there is a benefit analysis that arises from the utilization of such long columnar pieces 312, 314 of materials 302, 304. Specifically, there is a drawback that structure 320 will weigh more when longer columnar pieces 312, 314 or materials 302, 304 are utilized.

As such, a vehicle incorporating the embodiments described herein will consider the incident beam environment within which it will operate, and such considerations will be utilized in the selections of the metamaterials 302, the non-metamaterials 304 and the depth of the patterned structure 320.

The described embodiments are also utilized to provide high-contrast radar return scenarios, thereby preventing accurate radar detection and/or imaging of structures in the vicinity of a vehicle or other structure incorporating the three-dimensional structure 320 of metamaterials 302 and non-metamaterials 304. As described elsewhere herein, the embodiments reflect incident radiation back to its source, shielding the platform incorporating structure 320 from directed energy impinging thereon and returning that energy directly to its source.

As such, the described embodiments can also be utilized as a high-return radar target. A high return material on one vehicle can hide (via high contrast) the presence of other vehicles in its vicinity, and can confuse a receiver of the radar return signals as to the identity of, for example, an incoming vehicle. In terms of ground imaging, a high-return radar material can hide (via high contrast) other nearby assets.

The described embodiments, while perhaps considered the opposite of a "stealth" technology, can also be utilized to defeat multi-element radar systems (one emitter, and one detector located elsewhere) that can currently be used to detect certain current stealth vehicles. Radar stealth technology reflects incident radiation away in multiple directions such that no radiation is reflected directly back towards its source; multi-element radar defeats stealth technology by detecting the radiation reflected in other directions. A platform employing the described embodiments is only visible to a detector that is collocated with the transmitter, thus the described embodiment may be utilized to defeat multi-element radar systems.

As directly incident radiation is "transmitted" by the described embodiments, applications other than vehicle applications are also contemplated. For example, a low power application may include one or more privacy filters for monitors and window coatings. A modification of the described embodiments may be used within photovoltaic cells to more efficiently trap light. For such an application, slightly non-columnar shapes of metamaterials and non-metamaterials would be used. Such applications require the materials to be designed for performance within a different range of radiation wavelengths than do the directed energy and radar stealth applications.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A structure comprising:

a plurality of columnar pieces of metamaterial, and a plurality of columnar pieces of non-metamaterials, said columnar pieces arranged in an alternating pattern adjacent one another, the metamaterial and the non-metamaterial chosen such that indices of refraction for each are equal in magnitude, but opposite in sign, at a chosen wavelength, such that incident radiation is returned directly towards its source.

2. A structure according to claim 1 wherein said columnar pieces of metamaterial and said columnar pieces of non-metamaterial are square in cross-section.

3. A structure according to claim 1 wherein said columnar pieces of non-metamaterial comprise an optical material.

4. A structure according to claim 1 further comprising a substrate, said columnar pieces of metamaterial and non-metamaterial fabricated on said substrate.

5. A structure according to claim 1 wherein said columnar pieces of metamaterial comprise one of silica nanospheres suspended within a water matrix, silver nanowires within an aluminum oxide matrix, and nanocomponents with separation distances therebetween that are smaller than a wavelength of anticipated incident radiation received by said structure.

6. A structure according to claim 1 wherein said columnar pieces of non-metamaterial comprise one of glass, water, and aluminum oxide.

7. A structure according to claim 1 wherein the adjacent portions of said columnar pieces of metamaterial and said columnar pieces of non-metamaterial are substantially equal in dimension.

8. A structure according to claim 1 wherein said columnar pieces of metamaterial and said columnar pieces of non-metamaterial are of a length dependent on a range of angles for anticipated incident radiation.

9. A vehicle comprising:

a body comprising an outer surface; and a structure disposed on at least a portion of said outer surface, said structure comprising:

a plurality of columnar pieces of metamaterial, and a plurality of columnar pieces of non-metamaterials, said columnar pieces arranged in an alternating pattern adjacent one another, the metamaterial and the non-metamaterial chosen such that indices of refraction for each are equal in magnitude, but opposite in sign, at a chosen wavelength.

10. A vehicle according to claim 9 wherein said columnar pieces of metamaterial and said columnar pieces of non-metamaterial are square in cross-section.

11. A vehicle according to claim 9 wherein said columnar pieces of non-metamaterial comprise an optical material.

12. A vehicle according to claim 9 wherein said structure further comprises a substrate, said columnar pieces of metamaterial and non-metamaterial fabricated on said substrate.

13. A vehicle according to claim 9 wherein said columnar pieces of metamaterial comprise one of silica nanospheres suspended within a water matrix, silver nanowires within an aluminum oxide matrix, and nanocomponents with separation distances therebetween that are smaller than a wavelength of anticipated incident radiation received by said structure.

14. A vehicle according to claim 9 wherein said columnar pieces of non-metamaterial comprise one of glass, water, and aluminum oxide.

15. A vehicle according to claim 9 wherein the adjacent portions of said columnar pieces of metamaterial and said columnar pieces of non-metamaterial are substantially equal in dimension.

16. A vehicle according to claim 9 wherein said columnar pieces of metamaterial and said columnar pieces of non-metamaterial are of a length dependent on a range of angles for anticipated incident radiation.

17. A method for protecting a device from incident radiation, said method comprising:

arranging a plurality of columnar pieces of metamaterial and a plurality of columnar pieces of non-metamaterials arranged in an alternating pattern adjacent one another, the metamaterial and the non-metamaterial chosen such that indices of refraction for each are equal in magnitude, but opposite in sign, at a chosen wavelength; and applying the arranged columnar pieces on at least a portion of an outer surface associated with the device.

18. A method according to claim 17 wherein said arranging a plurality of columnar pieces of metamaterial and a plurality of columnar pieces of non-metamaterials comprises arranging columnar pieces of metamaterial and columnar pieces of non-metamaterial that are square in cross-section.

19. A method according to claim 17 wherein arranging a plurality of columnar pieces of metamaterial and a plurality of columnar pieces of non-metamaterials comprises arranging columnar pieces of an aluminum oxide matrix that includes silver nanowires within and columnar pieces of aluminum oxide.

20. A method according to claim 17 wherein arranging a plurality of columnar pieces of metamaterial and a plurality of columnar pieces of non-metamaterials comprises arranging columnar pieces of a water matrix that includes silica nanospheres within and water.

21. A method according to claim 17 wherein arranging a plurality of columnar pieces of metamaterial and a plurality of columnar pieces of non-metamaterials comprises arranging adjacent portions of metamaterial and non-metamaterial that are substantially equal in dimension.

* * * * *